US005588194A

United States Patent [19]

Ulbrich et al.

[11] Patent Number: 5,588,194

[45] Date of Patent: Dec. 31, 1996

[54] METHOD AND DEVICE FOR THE ACCUMULATION OF A YARN OVERLENGTH BETWEEN A BOBBIN CREEL AND THE BEAM ON A BEAMING MACHINE

[75] Inventors: Horst Ulbrich; Martin Fuhr, both of Niederuzwil, Switzerland

[73] Assignee: Benninger AG, Uzwil, Switzerland

[21] Appl. No.: 538,649

[22] Filed: Oct. 4, 1995

[30] Foreign Application Priority Data

Nov. 10, 1994 [CH] Switzerland ..... 3363/94

[51] Int. Cl.[6] ..... D02H 13/22

[52] U.S. Cl. ..... 28/194; 28/190

[58] Field of Search ..... 28/172.1, 185, 28/186, 190, 193, 194, 196, 197, 200, 201; 242/154, 153

[56] References Cited

U.S. PATENT DOCUMENTS

| | | | |
|---|---|---|---|
| 2,756,481 | 7/1956 | Bauer | 28/194 |
| 2,807,860 | 10/1957 | Buder et al. | 28/194 |
| 3,045,360 | 7/1962 | Alexeff et al. | 28/194 |
| 3,583,619 | 10/1971 | Shepard | 28/194 |
| 3,966,133 | 6/1976 | Gelin | 242/154 |

FOREIGN PATENT DOCUMENTS

| | | | |
|---|---|---|---|
| 967746 | 11/1957 | Germany | 28/194 |
| 4131489 | 3/1993 | Germany . | |

*Primary Examiner*—C. D. Crowder
*Assistant Examiner*—Larry D. Worrell, Jr.
*Attorney, Agent, or Firm*—Shoemaker and Mattare, Ltd.

[57] ABSTRACT

After yarn breakage, yarn loops are formed in an accumulator device (3) by rollers (13, 13') that are able to be displaced in relation to each other. The beam is rotated in reverse at a specific reverse speed (c) which is less than the accumulation speed of the accumulator rollers (13, 13'). The length difference arising from the difference between both the speeds is compensated by further withdrawal of yarns (a) from the creel (1) while the yarns are subjected to a defined braking tension of the individual yarn tensioners (7). Complex controls and speed synchronization are thus avoided.

11 Claims, 2 Drawing Sheets

METHOD AND DEVICE FOR THE ACCUMULATION OF A YARN OVERLENGTH BETWEEN A BOBBIN CREEL AND THE BEAM ON A BEAMING MACHINE

BACKGROUND

The invention concerns a method and a device for the accumulation of an overlength of yarns between a bobbin creel and the beam on a beaming machine. Such methods and devices serve the purpose, for example on a sectional warping plant, of enabling the uncovering of broken yarns that have continued to be wound prior to the beam coming to rest, without the formation of slack in individual yarns between the bobbin creel and the beaming machine. The unbroken yarns are accumulated with a definite yarn tension and in an ordered field, to be rolled out after repair of the broken yarn prior to the plant resuming its normal operating speed.

German patent document DA 41 31 489 discloses a comparable and related device wherein the yarn warp is held with the aid of two warp clamping rollers prior to the reversal of the beam and the actual accumulation procedure. Reverse rotation of the beam and displacement of the accumulator rollers is synchronous, the drive control for maintenance of yarn tension ensuing via a jockey roller. Other state of the art methods and devices operate according to the same principle, with the yarns being clamped continuously on the bobbin creel side.

A disadvantage of state of the art methods is that exact speed synchronisation between the accumulator device and the machine can only be achieved with difficulty and requires a relatively complicated control mechanism. Because the yarns are clamped on the creel side, even slight differences in speed can lead to over-stretching of the yarns to their break point, or to a drop below a minimum tension as soon as the jockey roller has reached its end position. Additionally, it is necessary to immediately open the yarn web clamp as soon as the accumulated yarn length has been rewound onto the beam, otherwise the clamping beam used for clamping the yarns on the creel side will lead to pinching of the yarns and subsequent fibre damage.

SUMMARY OF THE INVENTION

It is therefore a purpose of the invention to create a method that enables protective and reliable accumulation of the yarns without complicated speed control. According to the invention, this purpose is fulfilled by the method and device described below.

Sychronisation between the accumulation speed and the reversing speed, and thus a relatively complicated speed control, can be avoided in a surprisingly simple way if, in the absence of exact control, a slight speed difference is maintained and if the resultant length difference is compensated for by means of further withdrawal of yarns from the bobbin creel. For this purpose, it is merely necessary to subject each yarn to a defined tension, and this is usually anyway required in order to maintain tension in the yarn sheet. When accumulating the yarns, the maximum yarn length able to be accumulated does not have to be defined in terms of an exact number of centimeters. It is more important, however, that the yarns do not exceed a maximum permitted tension. This can be ensured simply by means of further withdrawal of the yarns from the bobbin creel, with only a negligible reduction in accumulation capacity having to be reckoned with.

Prior to reverse rotation of the beam, the yarn warp, running in the spread position for the beaming procedure, is preferably brought into one plane by means of accumulator rollers, the yarn lengths taken up in this case being further withdrawn from the creel.

As opposed to the state of the art, it is thus not necessary to apply initial clamping on the bobbin creel side before the accumulator rollers are brought into contact with the yarn warp. Rather, bringing together of the yarn sheet can be attained by the accumulator rollers themselves.

In order to deflect the yarn sheet from a central position, a lead-in guide roller can, when collecting up the yarn warp into the common plane, be moved into the yarn warp on the creel side, said yarn warp remaining in a central position while the accumulator rollers can be further displaced for the formation of loops. As opposed to state of the art clamping in the central position, the yarn warp is now solely deflected around the lead-in guide roller, without clamping. The lead-in guide roller can be moved either from above or from below into the yarn warp. On reaching the mid-position, a switching device can be activated, said switching device actuating the reverse run of the beaming machine. Reverse delivery of the yarn length is here always slightly shorter than the accumulated length. Length compensation ensues, as before, by means of further withdrawal from the creel.

Roll-out of the overlength can be achieved in a particularly simple way if the accumulator rollers are returned to their start position while the beam is inched forwards under power, wherein the crawling speed is greater than the roll-out speed of the accumulator rollers and wherein the length difference arising from the difference between the crawling speed and the roll-out speed being compensated by further withdrawal from the creel under the influence of yarn tensioners. Also in the case of roll-out, a slight partial length is with that continuously withdrawn from the creel so that a constant yarn tension can be maintained over and above the said speed difference.

A further purpose of the invention is to create a device with which the method described above can be carried out by simple constructional means. According to this invention, the lead-in guide roller on the creel side serves to introduce the yarn warp into the device without clamping, indeed into a central position that permits the formation of yarn loops upwards and downwards. The first yarn loop can here commence directly on the lead-in guide roller.

In the mid-position, the lead-in guide roller can activate a switching device for reversing the beam. Likewise, at least an upper and lower sensor can be arranged within the zone of movement of at least one accumulator roller, the end of the accumulation procedure or roll-out procedure being sensed by the sensors.

The traction mechanism can possess endless displacement chains running at the side of the machine frame around upper and lower chain deflection rollers, with an upper or lower accumulator roller being placed on each span of an endless chain.

A particularly advantageous construction for the accumulator device will result if it possesses a drive module and at least one detachable accumulator module mounted on the drive module, both the drive device for the traction mechanism and the lead-in guide roller being arranged in the drive module. In addition, the drive module can possess an upper and lower accumulator roller, so that even with only a drive module, restricted accumulation of yarns would be possible.

Further accumulator modules can be attached to the drive module, each accumulator module having in each case an upper and a lower accumulator roller. The drive module's traction mechanism is connected either to the drive module or the preceding accumulator module. The maximum accumulated length can be determined by the number of accumulator modules connected.

The expressions "Accumulator Roller" and "Lead-in guide Roller" relate preferably to a cylindrical body mounted to rotate with low resistance, around which the yarns can be deflected without damage.

BRIEF DESCRIPTION OF THE DRAWINGS

An embodiment of the invention is shown in the drawings wherein.

DESCRIPTION OF THE PREFERRED EMBODIMENT

Figure 1:
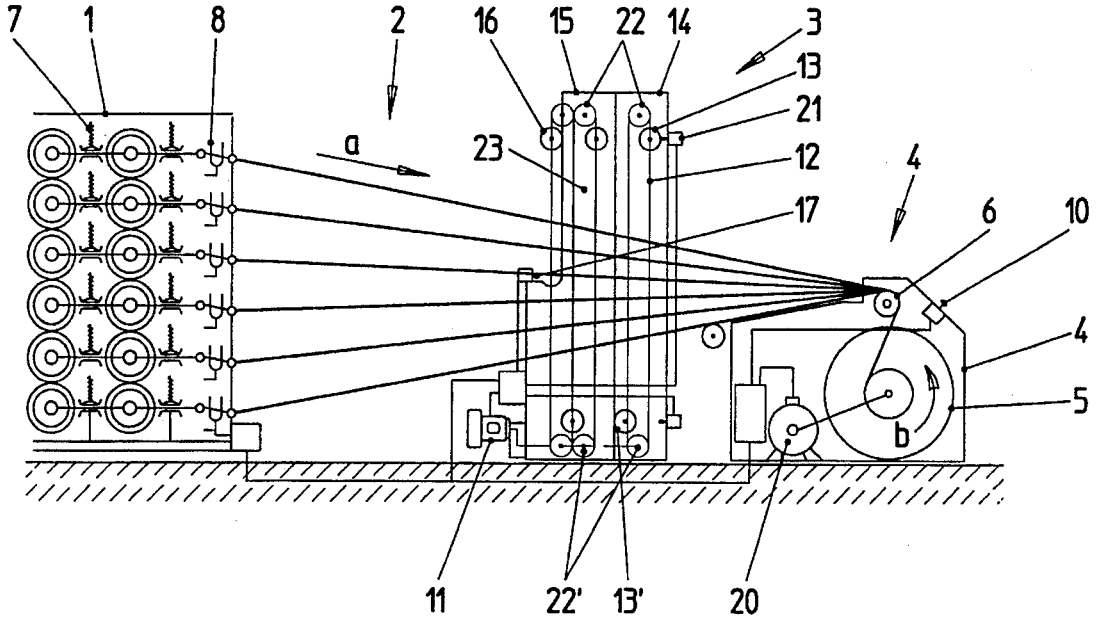
FIG. 1 is A highly schematic representation of a side view of a warping plant with an accumulator device between the creel and the beaming machine.
Figure 2:
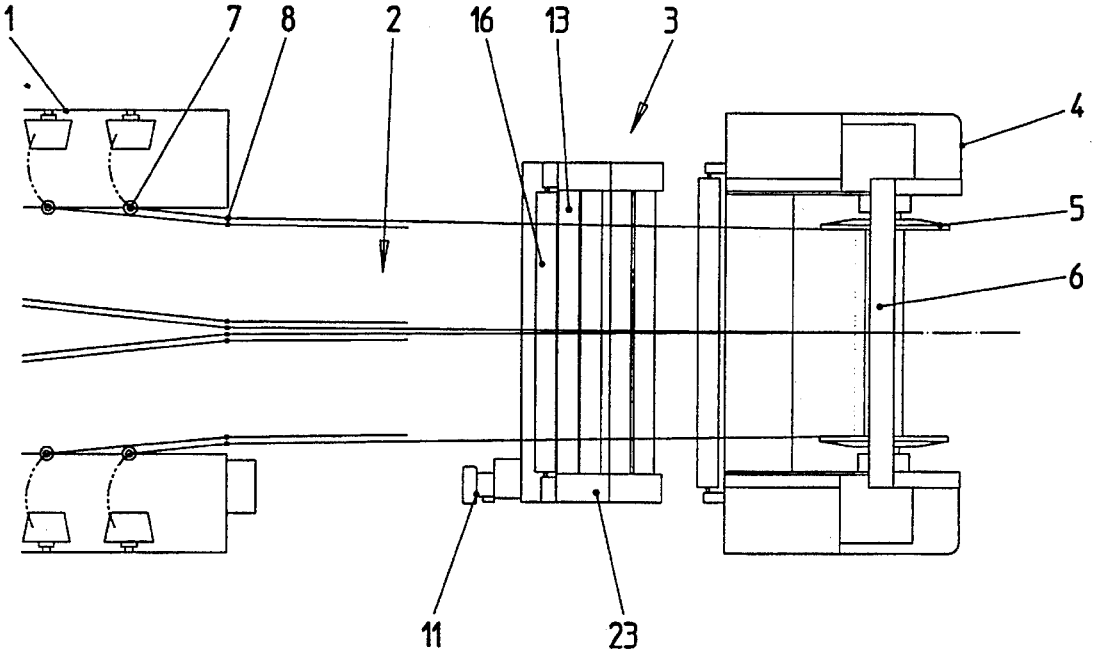
FIG. 2 is a plan view of the plant according to FIG. 1.

FIGS. 1 and 2 show a warping plant in normal operation, wherein warp yarns 2 are led in a vertically ray-formed and horizontally almost parallel yarn sheet from a bobbin creel 1 through an accumulator device 3, and are wound by a warping machine 4 via a guide roller 6 onto a warping beam 5. The yarns here move in the direction of the arrow a and the warping beam rotates in the direction of rotation b. The yarn warp 2 is, in the beaming position shown, led through the accumulator device 3 without making contact.

Each warp yarn is provided with a controllable yarn tensioner 7 at a defined braking tension, and monitored by a yarn monitor 8. In the case of yarn breakage, the yarn monitor will trigger a stop of the warping machine 4, and simultaneously a defined increased yarn braking action on all yarn tensioners 7. Depending on the actual position of the yarn breakage, winding of the broken yarn onto the beam 5 may not, however, be prevented. For this reason, the warp already wound onto the beam must subsequently be ordered, at a defined tension, within the accumulator device 3, in order to expose the broken end.

The accumulator device 3 comprises a machine frame 23 in which vertically and contrarotating mobile upper and lower accumulator rollers 13 and 13' are mounted. The mounting and motion of the said accumulator rollers is attained via a traction mechanism 12 that is preferably formed by endless displacement chains on the paternoster transport principle. Each chain loop is mounted at the side of the machine frame around upper and lower chain deflection wheels 22 or 22', and in each case an upper and lower accumulator roller is attached at the centre of each chain span. Depending on the direction of rotation of the chain, the said accumulator rollers on neighbouring spans will move towards or away from one another.

A lead-in guide roller 16 is arranged on the creel side, said roller also being able to be mounted in the same way on lateral chains.

Preferably, the lead-in guide roller is mounted in bearings so as to dislocate, said bearings being mounted on a chain on which an accumulator roller is also mounted. This lead-in guide roller moves, however, only as far as a limit-stop/support 17 in a mid-position, at which point it is dislocated out of its support bearings while the chain moves further. The mid-position is approximately on the plane on which the upper and lower accumulator rollers 13 and 13' cross. A press-switch 18 is provided on the limit-stop/support 17, with the beaming machine motor 20 being able to be controlled with the aid of said press-switch.

The lead-in guide roller 16 is, together with a pair of accumulator rollers, arranged on a drive module 15, the drive module also supporting the accumulator drive motor 11 for the drive of the traction mechanism. An accumulator module coupled to said drive module supports a further pair of accumulator rollers. In addition, a lower limit sensor 19 and upper limit sensor 21 are arranged on the accumulator module. A presss-witch 10 is arranged on the beaming machine 21, with the accumulation and roll-out procedure able to be actuated on said press-switch. A defection roller 24 causes a common deflection of the yarn warp during roll-in and roll-out.

Figure 3:
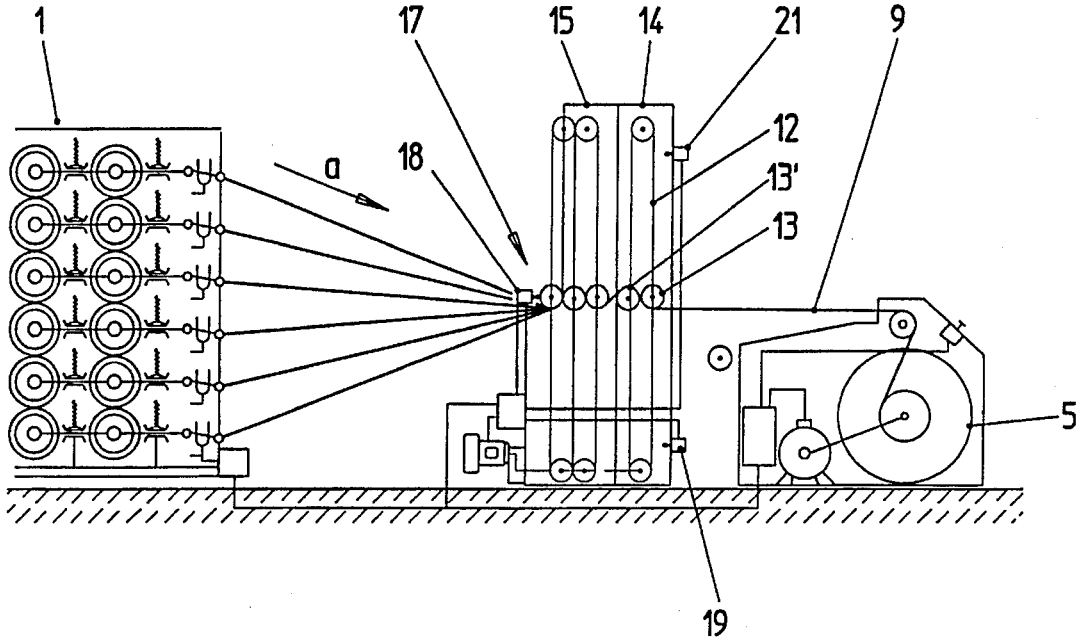
FIG. 3 shows the plant according to FIG. 1 during preparation of the accumulation procedure and, FIG. 4 illustrates the plant according to FIG. 1 during accumulation of the yarns.

In FIG. 3, the warping machine has been stopped via the affected yarn monitors 8. The yarn tensioners 7 are subjected to a raised braking force. The accumulator drive 11 is actuated by means of the manual presss-witch 10, the upper and lower accumulator rollers 13 and 13' thus moving towards each other. Simultaneously, the lead-in guide roller 16 is lowered into the yarn sheet. Thereafter, the yarn sheet is continuously brought to a mid-position. The differential yarn lengths taken up in this case, although relatively slight, are withdrawn from the creel in the direction of the arrow a. The mid-position is reached as soon as the lead-in guide roller 16 has reached the limit-stop/support 17 and, with that, actuated the press switch 18.

Only at this point is the beaming machine motor 20 reversed at a specific reverse speed. The upper and lower accumulator rollers 13 and 13' cross and distance themselves one more, with yarn loops evidently being formed. With that, the beam rotates back in the direction c, and the already wound warp 9 is drawn into the accumulator device 3 in the direction of the arrow d. The reverse speed is, however, less than the accumulation speed of the enlarging yarn loops so that a differential length is withdrawn from the creel in the direction of the arrow a. Yarn tension is held at a constant, however.

Figure 4:
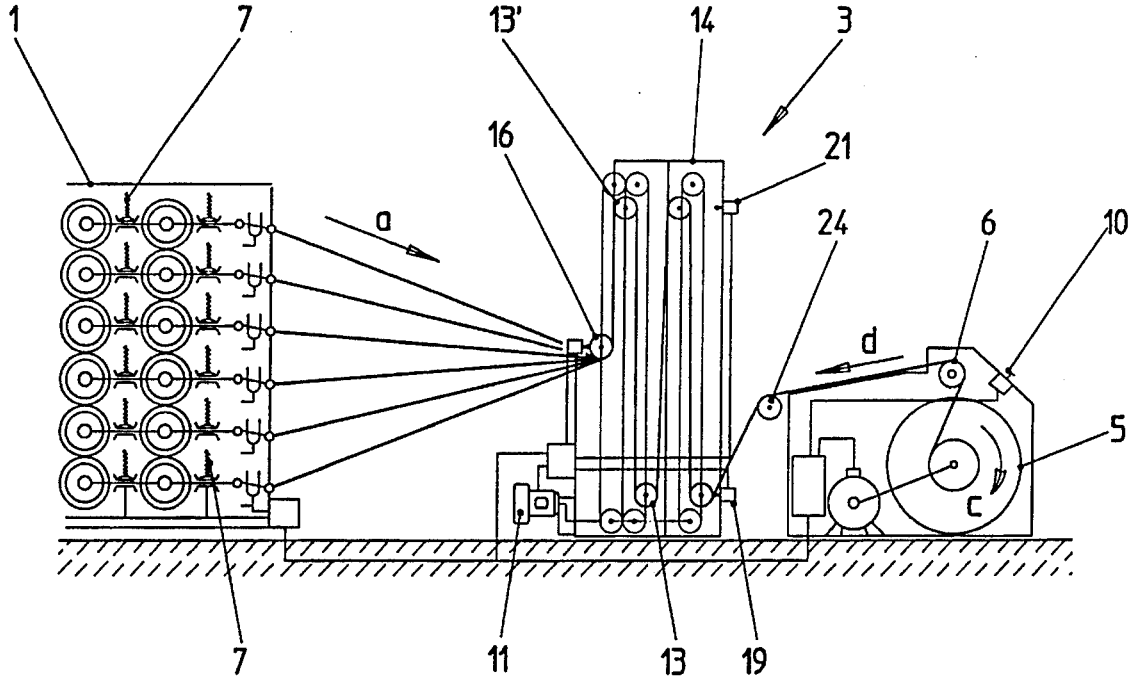

In to FIG. 4, the accumulator device 3 has reached its maximum capacity. The lower accumulator rollers 13', in the rest position, are now in the upper end position, and vice versa. Both the accumulator drive 11 and the beaming machine motor 20 have been switched off by means of the limit-sensor 19. The broken yarn is now exposed and can be retied.

In order to roll-out the accumulated overlength, the manual press-switch 10 on the beaming machine is pressed once again. Then, simultaneous inching of the warp beam 5 and reversal of the accumulator drive 11 is actuated. The crawling speed is greater than the roll-out speed of the reducing yarn loops, the length difference so arising once again being taken from the bobbin creel 1. The roll-out speed is ended by actuation of the upper limit press-switch 21. All reverse and forward warp lengths are recorded by the guide roller 6. The machine has once again reached the start position shown in FIG. 1 and can assume normal beaming operations.

Inasmuch as the invention is subject to modifications and variations, the foregoing description and accompanying drawings should not be regarded as limiting the invention, which is defined by the following claims and various combinations thereof:

We claim a:

1. Method of accumulating an overlength of yarns between a bobbin creel (1) and the beam (5) of a beaming machine (4), upon cessation in beaming, said method comprising steps of deflecting a yarn warp (2) from a beaming position into an accumulation position under the formation of yarn loops by means of accumulator rollers (13, 13') that are displaceable in relation to one another, while rotating the beam (5) in a reverse direction, subjecting each yarn to a defined braking tension at the bobbin creel, while maintaining the reverse speed of the beam at less than the accumulation speed of the accumulator rollers so that the length difference arising from the difference between the reverse speed and the accumulation speed is compensated for by further withdrawal of yarns from the bobbin creel under the influence of yarn braking tension.

2. Method according to claim 1, comprising a further step of, prior to reverse rotation of the beam, bringing the yarn ward (2), running in the spread position for the beaming procedure into one plane by means of the accumulator rollers (13, 13') and further withdrawing the yarn lengths thus taken up from the bobbin creel.

3. Method according to claim 2, comprising a further step of, while the yarn warp is being brought into one plane, moving a lead-in guide roller (16) into said warp plane on the creel side, said lead-in guide roller remaining in the common plane in a mid-position while the accumulator rollers (13, 13') are further displaced for formation of yarn loops.

4. Method according to claim 3, comprising a further step of actuating a switching device (18) upon reaching the mid-position, said switching device actuating the reversal of the beaming machine.

5. Method according to claim 1, comprising a further step of returning the accumulator rollers (13, 13') to their start position while the beam is driven forwards at crawling speed, the crawling speed being greater than the roll-out speed of the accumulator rollers, wherein the length difference arising from the difference between the crawling speed and the roll-out speed is compensated by further withdrawal from the bobbin creel under the influence of braking tension.

6. Device for accumulation of an overlength between a bobbin creel (1) and the beam (5) of a beaming machine (4) in the case of a cessation of beaming, said device comprising a machine frame (23) through which the yarn warp (2) can be guided, in each case a lower and an upper group of parallel accumulator rollers (13, 13') being attached to a traction mechanism (12) in such a way that both groups are able to be displaced in opposite directions approximately vertically for the formation of yarn loops, wherein for clamping-free introduction of the yarn warp (2), at least one lead-in guide roller (16) is arranged on the creel side, said lead-in guide roller being movable from a position outside the yarn warp into a mid-position within the yarn warp, the mid-position lying approximately on a plane on which the groups of accumulator rollers (13, 13') cross.

7. Device according to claim 6, wherein the lead-in guide roller (16) may be lowered from above onto a limit-stop/support (17) arranged in the mid-position on the machine frame, and that on reaching said limit-stop/support, a switching device (18) can be actuated to reverse the beam.

8. Device according to claim 6, further comprising a limit sensor (19, 21) which can be actuated by means of one accumulator roller at its upper and lower end position, the accumulation or roll-out procedure being able to be detected by said limit sensor.

9. Device according to claim 6, wherein the traction mechanism (12) has endless chains fitted at the side of the machine frame around upper and lower chain deflection wheels (22, 22') and a lower or upper accumulator roller is fixed on each span of an endless chain.

10. Device according to claim 6, further comprising accumulator roller arranged in the direction of yarn run (a) immediately after the lead-in guide roller, said accumulator roller being movable in the opposite direction to the lead-in guide roller.

11. Device according to claim 6, further comprising a drive module (15) and at least one detachable accumulator module (14) attached to said drive module, the drive module being equipped with a drive motor (11) for the traction mechanism (12) and with the lead-in guide roller, and the accumulator module possessing in each case at least one upper and one lower accumulator roller (13, 13'), and means for coupling the traction mechanism of said accumulator rollers to the drive module.

* * * * *